United States Patent [19]

Bodendoerfer

[11] 4,349,345

[45] Sep. 14, 1982

[54] BLANK WRAPPING MECHANISM FOR NON-CYLINDRICAL CONTAINER-MAKING MACHINES

[75] Inventor: Raymond E. Bodendoerfer, Brookfield, Wis.

[73] Assignee: Paper Machinery Corporation, Milwaukee, Wis.

[21] Appl. No.: 186,911

[22] Filed: Sep. 15, 1980

[51] Int. Cl.[3] ..... B31B 1/28

[52] U.S. Cl. ..... 493/295; 493/153; 493/164; 493/176

[58] Field of Search ..... 493/295, 153, 176, 175, 493/112, 111, 164, 252, 105, 102, 152; 53/218

[56] References Cited

U.S. PATENT DOCUMENTS

| | | | |
|---|---|---|---|
| 755,754 | 3/1904 | Day et al. | 493/252 |
| 989,789 | 4/1911 | Maxwell | 493/295 X |
| 1,378,581 | 5/1921 | Bernotow | 493/175 X |
| 2,224,779 | 12/1940 | Chalmers et al. | 493/252 X |
| 2,725,001 | 11/1955 | O'Neil | 493/105 |
| 3,327,452 | 6/1967 | Cranston, Jr. et al. | 53/218 |
| 4,033,241 | 7/1977 | Roda | 493/295 |
| 4,308,023 | 12/1981 | Bidegain | 493/295 |

FOREIGN PATENT DOCUMENTS

| | | | |
|---|---|---|---|
| 820049 | 9/1959 | United Kingdom | 493/176 |

*Primary Examiner*—James F. Coan
*Attorney, Agent, or Firm*—James E. Nilles

[57] ABSTRACT

A machine for making non-cylindrical paper container, including wings for wrapping a container blank around a non-cylindrical mandrel. The wings each have a supplement wing portion pivotably attached thereto, and as the wings are moved into the mandrel-engaging position, a mandrel-contacting part of the supplement wing portions that abuts against the mandrel causes those portions to swingingly approach the mandrel. In this manner, the wing portions may move unobstructively past the mandrel as the wings and wing portions wrap the blank against the mandrel.

8 Claims, 9 Drawing Figures

BLANK WRAPPING MECHANISM FOR NON-CYLINDRICAL CONTAINER-MAKING MACHINES

BACKGROUND OF THE INVENTION

1. Field of Use

The invention relates to machines for making non-cylindrical paper containers. In particular, it relates to machines for making such containers by wrapping a pre-formed blank around a non-cylindrical mandrel with a pair of wings, each of which has pivotably attached thereto a supplement wing portion to enable wrapping the blank around the mandrel without obstruction of the wing or wing portion by the non-cylindrical mandrel.

2. Description of the Prior Art

Paper containers can be produced in a variety of ways. One widely known method of paper container manufacture is described in my U.S. Pat. No. 2,942,530, issued June 28, 1960, and also in my U.S. Pat. No. 3,745,891, issued July 17, 1973, both patents being entitled "Blank Wrapping Mechanism for Frusto-Conical Cup-Making Machines". These patents describe a method in which a pre-formed paper blank is automatically loaded at a point below a cylindrical or frusto-conical mandrel. A pair of wrapping arms or wings then engage the body blank, causing it to be wrapped around the mandrel with one end of the blank slightly overlapping the other so that the ends may be attached to each other by heat-sealing or with glue to form a seam. Each wing of the pair shown in the machines described in the two prior art patents is a one-piece wing. The wings substantially conform to the shape of the mandrels, and move smoothly and without obstruction from the blank-loading position away from the mandrel to the blank-wrapping position adjacent and around the mandrel.

A one-piece wing, however, is not suitable for wrapping blanks on mandrels of a substantially non-cylindrical cross-section, such as elongated or rectangular cross-sections. If a one-piece wing were used on a cup-making machine as shown in the prior art, but with substantially rectangular mandrels and wings shaped to conform thereto, that portion of each wing intended to contact and squeeze the blank against the uppermost portion of the mandrel would, at its end, strike the side of the mandrel, making it impossible to wrap the blank. This problem renders a blank forming machine useless for anything but substantially cylindrical containers.

SUMMARY OF THE INVENTION

The invention relates to a machine for making generally rectangular in shape paper containers, comprising a wing mechanism for urging a preformed paper blank against a generally rectangular in cross-section mandrel and progressively pushing the blank against and around each side of the mandrel to cause the blank to form an overlapped portion along one side of the mandrel. The wing mechanism includes a pair of wings complementary shaped to the mandrel and pivotably mounted on the machine at a point adjacent one side of the mandrel. Each of the wings has pivotably attached thereto a supplement wing portion for pivoting between an open position away from one another and a position tightly pressing the blank against the mandrel, in which latter position the supplement wing portions form an overlapped portion of the container. In the open position, the supplement wing portions move without obstruction past the mandrel as the wings wrap the blank against the mandrel. To attain the tightly pressing position, the supplement wing portions are caused to pivot to and tightly press the blank against the mandrel when a mandrel-contacting part of each supplement wing portion abuts against the mandrel. The mandrel-contacting part abuts against the mandrel as the wing is moved into position along the mandrel, that is, when the supplement wing portions are swingingly approaching the mandrel.

The invention offers several advantages over the prior art. Because the wings with their supplement wing portions move out of the way and do not strike a non-cylindrical mandrel as they move from a blank-loading position to a blank-wrapping position adjacent the mandrel, the wings are usable on existing mandrel and blank wrapping machines, eliminating the need to buy separate machines for cylindrical and non-cylindrical containers.

These and other objects and advantages of the present invention will appear hereinafter as this disclosure progresses, reference being had to the accompanying drawings.

DESCRIPTION OF THE PREFERRED EMBODIMENTS

Figure 1:
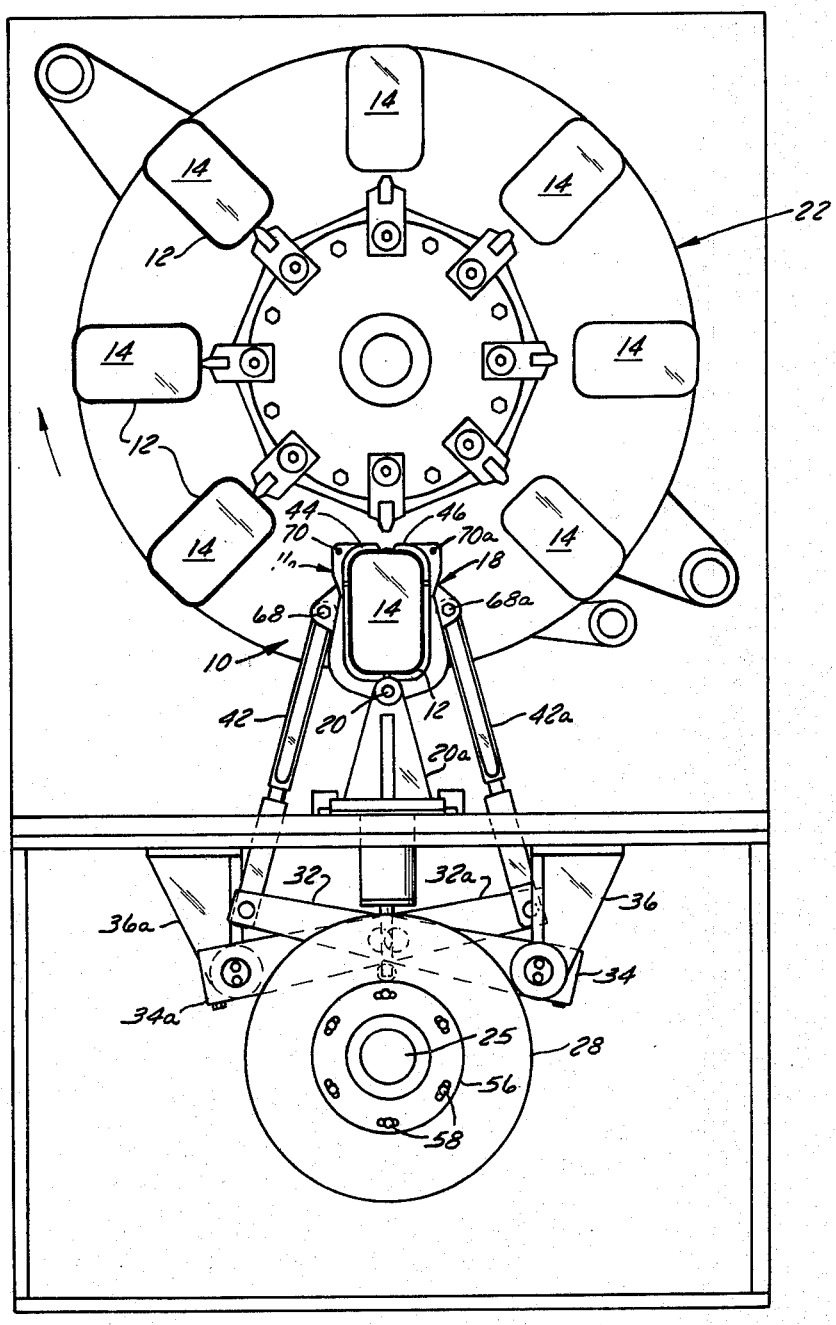
FIG. 1 is a front elevational view of a blank wrapping mechanism made in accordance with the present invention and showing the wings in the wrapped position.

The machine described herein is suitable for the manufacture of any paper containers of a substantially non-cylindrical shape, particularly those which cannot be manufactured by shaping a blank on a mandrel with a one-piece wing because of interference between the end of each wing and the mandrel as the wing is lifted into place on the mandrel. Containers of various shapes, including those with rectangular, elongated, and other substantially non-circular cross sections, may be produced by this machine. In this embodiment, the machine described will be suitable for making substantially rectangular containers.

The container-making machine is generally of the type having a successively indexable turret 22, with a container manufactured thereon moving to various stations of that turret for different fabrication steps, such as heat sealing, bottom turn-in, bottom finish, bottom punch and draw, and folding or container shaping, which latter step is aided by the swingable wing mechanism 10 described hereinbelow. At the container shaping station, a preformed blank is wrapped around a generally rectangular in cross-section mandrel 14, each turret station having such a mandrel mounted thereon.

The swingable wing mechanism 10 urges the preformed blank 12 against the mandrel 14, and the blank 12 is inserted between a pair of wings 16 and 18 and the mandrel 14 by a set of grippers mounted on an oscillatable shaft on which is secured a rack-driven pinion, all of which are described and shown in said U.S. Pat. No. 2,942,530.

The wing mechanism 10 has its pair of wings 16 and 18 pivotably mounted on the machine about a common pivot point formed by stub shafts 19 and 20. The stub shafts are mounted in brackets **19*a* and 20*a* which are rigidly mounted on frame F. The wings pivot about the stub shafts 19 and 20 from an open position in which they are unwrapped from the mandrel to a position in which they are wrapped around the mandrel. In the unwrapped position (FIG. 6), the wings have a shape complementary to the mandrel, and are spaced from the mandrel. In the wrapped position (FIG. 2), the wings 16 and 18** are adjacent the mandrel and have progressively pushed the blank against and around each side of the mandrel.

Figure 5:
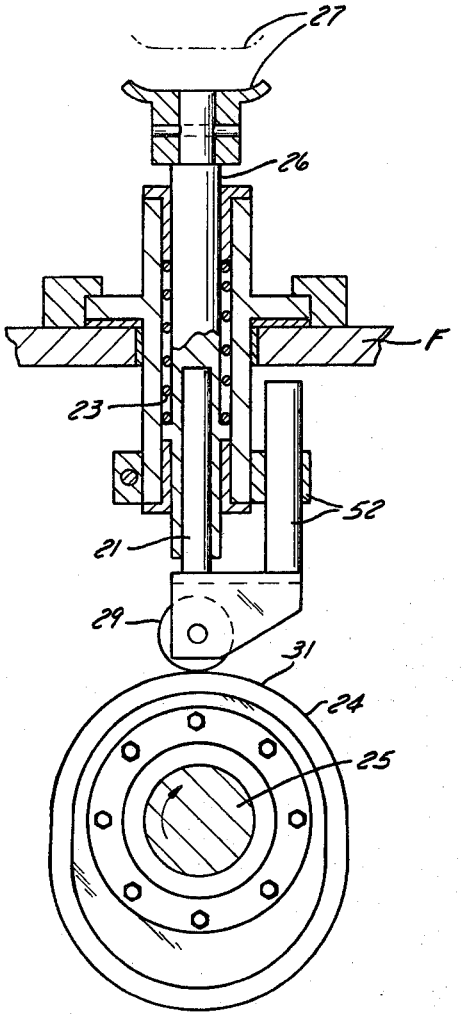
FIG. 5 is a sectional view of the blank holding pad and its actuation means, taken along lines 5—5 of FIG. 3, but on a reduced scale.

To prevent shifting of the paper blank 12 on the mandrel when the blank is first engaged by the wings 16 and 18, and to hold the blank firmly to the mandrel after the grippers have positioned the blank, shiftable blank holding means (FIG. 5) are provided, and include a blank holding pad 27, a vertically shiftable rod 26, shiftable rod roller means 29, a push rod 21 connected to said roller means and slideable within said rod 26, and spring biasing means 23. The blank holding means operates in timed relationship with the wings and is shiftable between a position in which it holds a paper blank 12 against the mandrel 14 at a location between the wings 16 and 18, prior to swinging of the wings to the tightly pressing position, and a position away from the blank 12 for releasing the blank after the wings have wrapped it around the mandrel. Means are also provided for actuating the shiftable means in timed relationship with the power operated means which swing the wings together to engage the mandrel. This actuating means comprises a rotatable cam 24, the powered shaft 25 and power means (not shown) used to swing the wings 16 and 18 upwardly, as will appear.

The rotatable cam 24 is rotated by the power driven shaft 25. The push rod 21 has roller means 29 attached to its lower end which rides on a cam surface 31 of rotatable cam 24, the roller means 29 being provided with vertical guide means 52 to prevent swiveling thereof while roller means 29 rides on the cam surface 31. As the cam 24 is rotated, the roller means 29 on cam surface 31 is raised and lowered on the cam. As the roller means 29 rises, it moves push rod 21 upwardly and the push rod 21, whose upper end abuts the bottom of a bore within vertically shiftable rod 26, forces rod 26 upwardly as well as move pad 27 into a position in which it engages the blank and mandrel. Spring biasing means 23 are provided on rod 26 for maintaining contact between roller means 29 and the vertically shiftable rod with the cam surface 31 during rotation of cam 24. In order that the pad 27 may contact the mandrel from below, wings 16 and 18 have bifurcated lower ends. The pad 27 is maintained holding the blank 12 to mandrel 14 until after wings 16 and 18 begin swinging away from mandrel 14.

Power operated means are provided for swinging each of the pair of wings 16 and 18 together in tight engagement with the blank 12 around a portion of the mandrel 14. As the power-operated swinging means for each wing 16 and 18 have essentially identical components and functions, only the operation of the means for wing 16 is explained. The components of the swinging means for wing 18 are generally identified by the same numbers are those of the swinging means for wing 16, together with the suffix "a".

Figure 2:
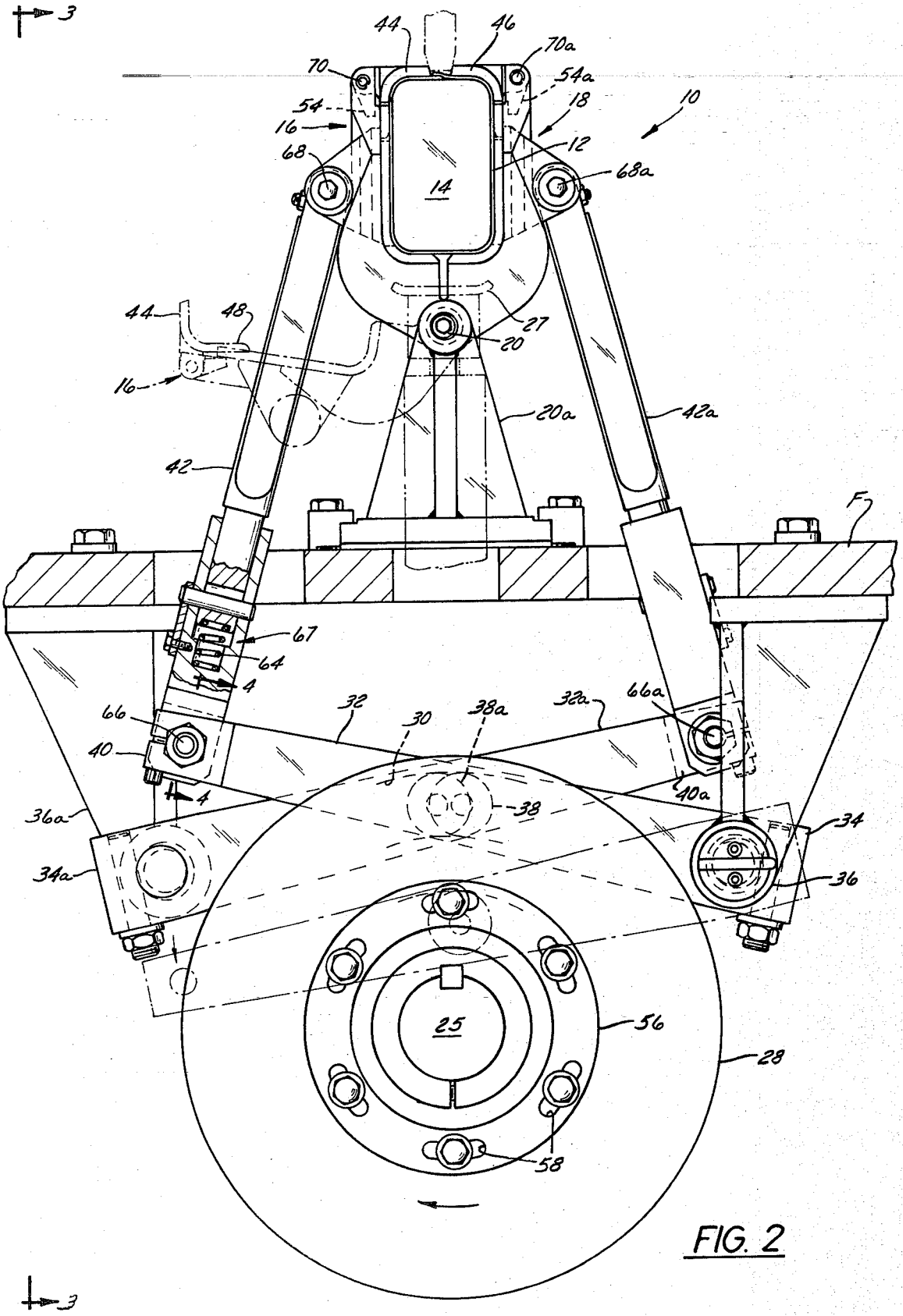
FIG. 2 is a fragmentary and schematic view taken in the same direction as the device of FIG. 1, but on an enlarged scale, and showing a seam sealing element in place on the mandrel between the wings in the wrapped position, and showing in phantom the position of the left wing and its actuating lever when the wing is in the unwrapped position.
Figures 3, 4:
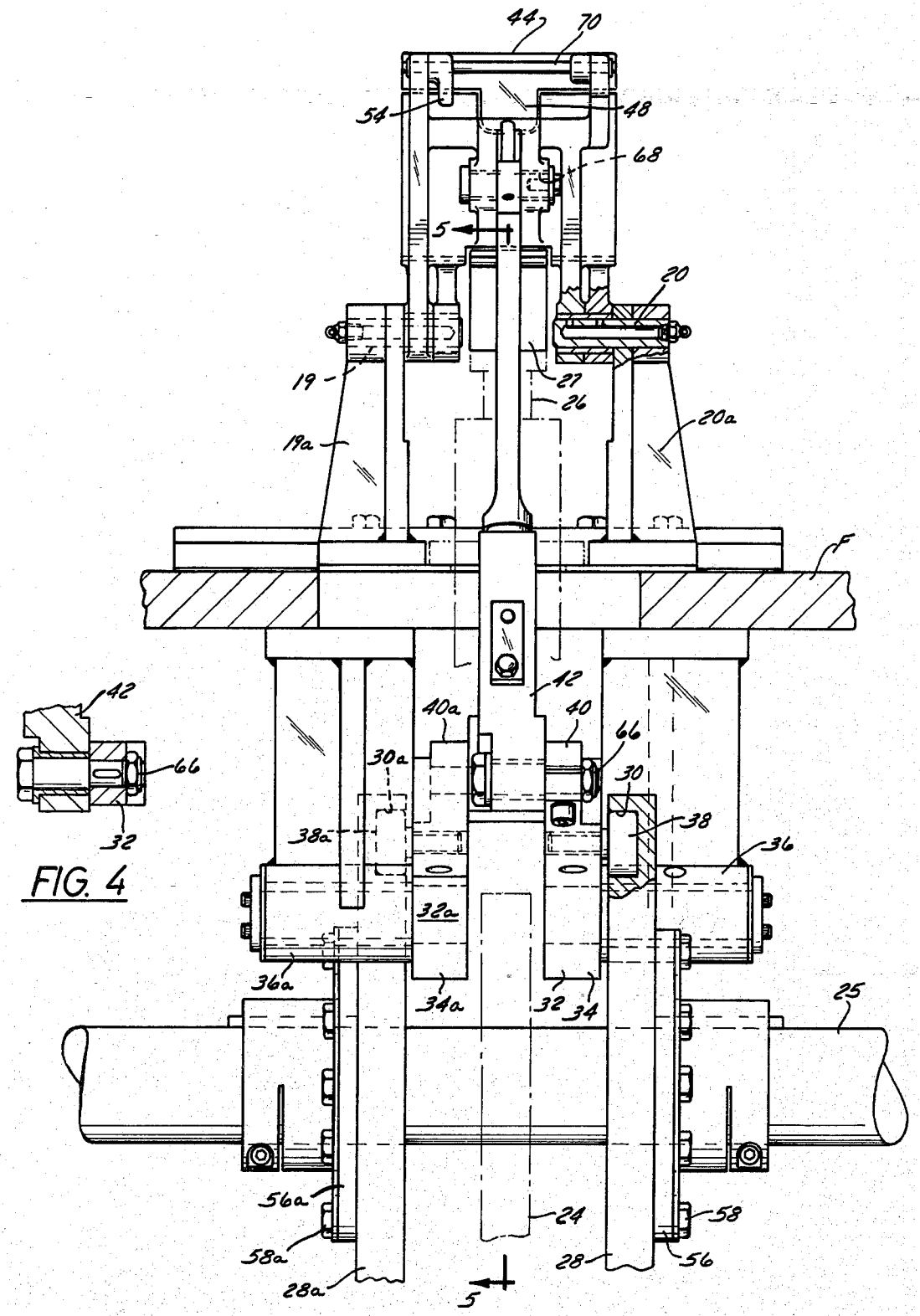
FIG. 3 is a side elevational view, partially in section, of the mechanism as shown generally in FIG. 2, taking along lines 3—3 in FIG. 2.
FIG. 4 is a cross-sectional view of the pivotal connection between the link and lever for the left wing, taking along lines 4—4 of FIG. 2.

A rotatable cam 28 is powered by the same power means and powered shaft 25 as is rotatable cam 24, and has a cam track 30 thereon. The cam 28 is shiftable relative to a timing hub 56 attached thereto, the hub 56 being secured to the cam with bolts through a plurality of slots 58 in the hub. Linkage means are provided, comprising a link 42, a cam follower 38, and a lever 32. The lever 32 is pivotably attached at its one end 34 to the machine frame F by an arm 36 attached to and extending downwardly from the machine. An eccentric is provided at this attaching point to enable changes in cam timing to be made. The cam follower 38 is attached to the lever 32 intermediate its length, and rides in the cam track 30. The other end 40 of the lever is pivotably attached at pin 66 to the lower end of the link 42, which in turn is pivotably attached at its upper end about pin 68 to wing 16. As the cam 28 rotates and the cam follower 38 periodically rises in its cam track 30, lever 32 shifts from its position shown in phantom to the position shown in solid lines (FIG. 2). In rising to this position, link 42 is caused to move upwardly and moves wing 16 from the open position (FIG. 6) away from the mandrel 14 to the wrapped position (FIG. 2) adjacent to the mandrel 14. To prevent overloading of lever 32, arm 42 is provided with a telescopic spring-biased lost-motion connection 67. If the other end 40 of lever 32 is moved upwardly by the cam 28 beyond its position as shown in FIG. 2, the lost motion connection 67 will compress to take up the over-travel thereby preventing damage to wing 16 and mandrel 14, which damage could result from excessive upward movement of a non-telescopable link. When the cam causes downward movement of lever 32, the tension on the spring 64 is relieved. Thus, rotation of the rotatable cam 28 causes actuation of the cam follower 38 in the cam track 30, and rising of both the other end 40 of lever 32 and link 42 to cause successive wrapping and unwrapping of the wing 16 around the mandrel 14.

As the paper blank 12 is folded by wings 16 and 18 upon the mandrel 14, the longitudinal edges of that paper must overlap to form a seam (as shown between wings 16 and 18 in FIG. 2) that can be glued or heat-sealed. In order that one edge of the blank 12 overlaps the other, one wing must being its wrapping of the blank 12 upon the mandrel 14 prior to the other wing.

For this to happen, with wing 16 operating slightly in advance of wing 18, cam 28 must raise lever 32 slightly in advance of the raising of lever 32*a* by cam 28*a*. The ends of wings 16 and 18, as will be further explained below, have a space therebetween leaving an unobstructed area through which the overlapped edges or seam may be reached by a seam-sealing element.

Figure 9:
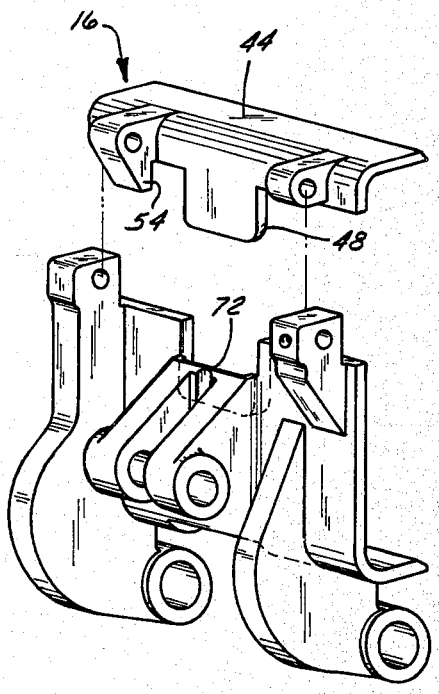
FIG. 9 is a perspective view of the wings and supplement wing portions of the mechanism.
Figure 7:
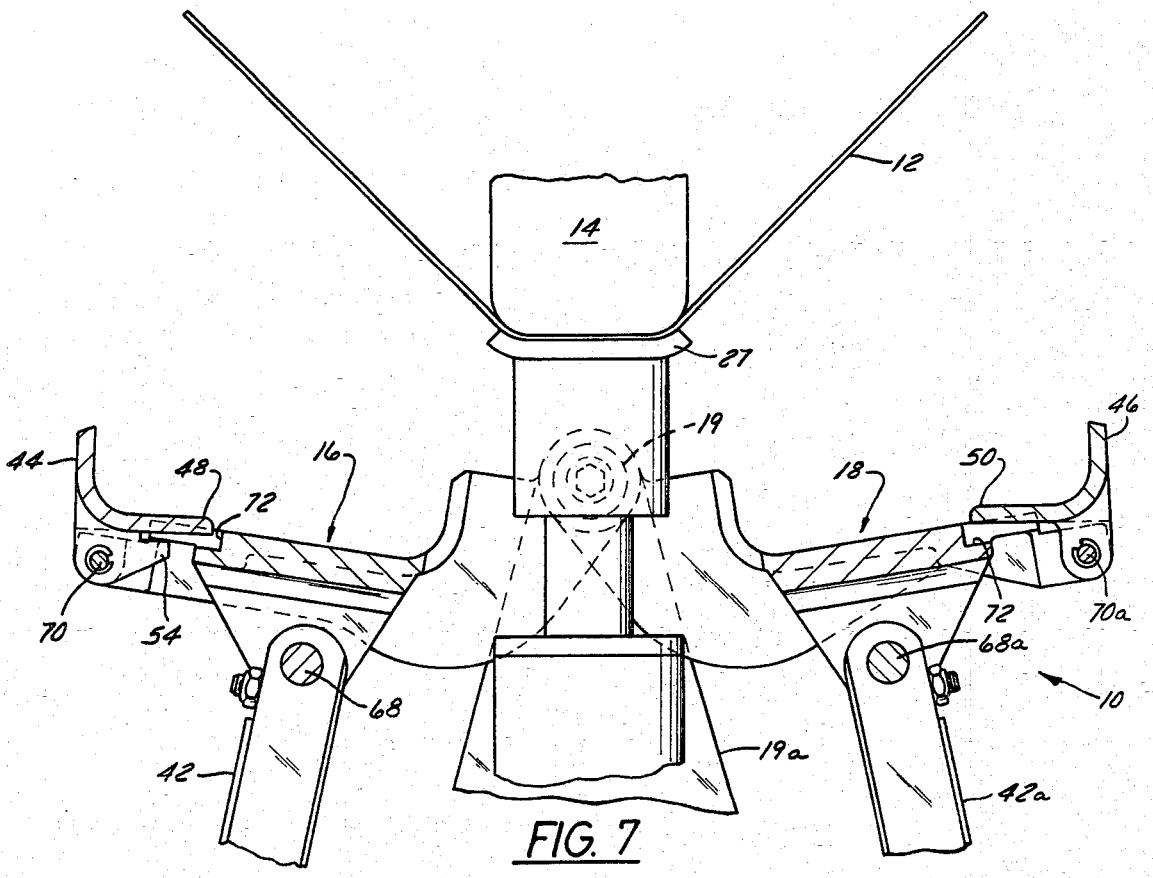
FIG. 7 is a view similar to FIG. 6 showing the blank holding pad engaging the blank against the mandrel.

To ensure that the ends of wings 16 and 18 do not contact the side of the mandrel 14 upon the wings' swinging from the unwrapped to the wrapped position, each has a generally right-angular in shape supplement wing portion 44 and 46 pivotably attached thereto about a wing pin 70 and 70*a*, respectively, at a point intermediate the length of that portion. Normally, with the wings in the unwrapped position or beginning their ascent to the wrapped position, the supplement wing portions 44 and 46 are in an open position as shown in FIG. 7, with stop tabs 54 (FIG. 9) on the supplement wing portions 44 and 46 limiting the pivoting of those wing portions, and oriented such that their mandrel-contacting parts 48 and 50 are angularly disposed with respect to the portions of the wings 16 and 18 to which they are nearest. Legs or mandrel-contacting parts 48 and 50 are the parts of the supplement wing portions 44 and 46 which initially abut against the mandrel 14. As the wings 16 and 18 move upward towards the mandrel 14, the legs 48 and 50 begin abutting the mandrel 14, and the supplement wing portions 44 and 46 are forced to pivot upon the points at which they are pivotably attached to their respective wings until they are finally in a position in which they are within a pocket 72 to ensure a flush-fit for the wing and are also tightly pressing the blank 12 against the mandrel 14 to form the overlapped portion of the container, as shown in FIG. 2. In this tightly pressing position, the legs 48 and 50 are no longer angularly disposed but rather are linearly disposed with respect to the wings where the wings and supplement wing portions are adjacent. In the position in which the supplement wing portions tightly press the blank 12 against the mandrel 14 to complete the blank's forming, the adjacent ends of supplement wing portions 44 and 46 each have a free end spaced apart from one another. The space between the free ends reveals the overlapped portion of the paper blank 12, now shaped into a container, and unobstructively permits a seam-sealing element (FIG. 2) to be received thereby. This element may comprise a seal clamp mounted above each mandrel and adapted to be lowered at an appropriate time to bear against the glued and overlapped edges of the blank to thus seal them together.

Operation

Figure 6:
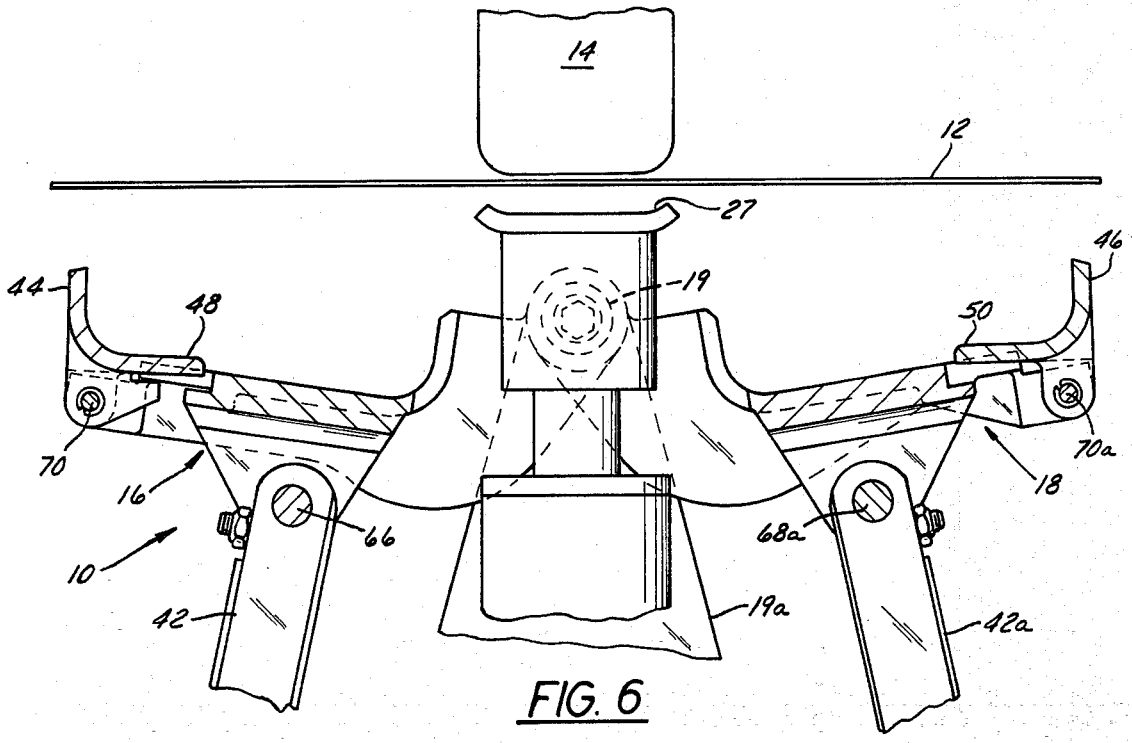
FIG. 6 is a fragmentary view of a portion of the showing in FIG. 2, but on an enlarged scale and certain parts shown in section, showing the paper blank in a position adjacent the mandrel and about to be engaged by the blank holding pad.
Figure 8:
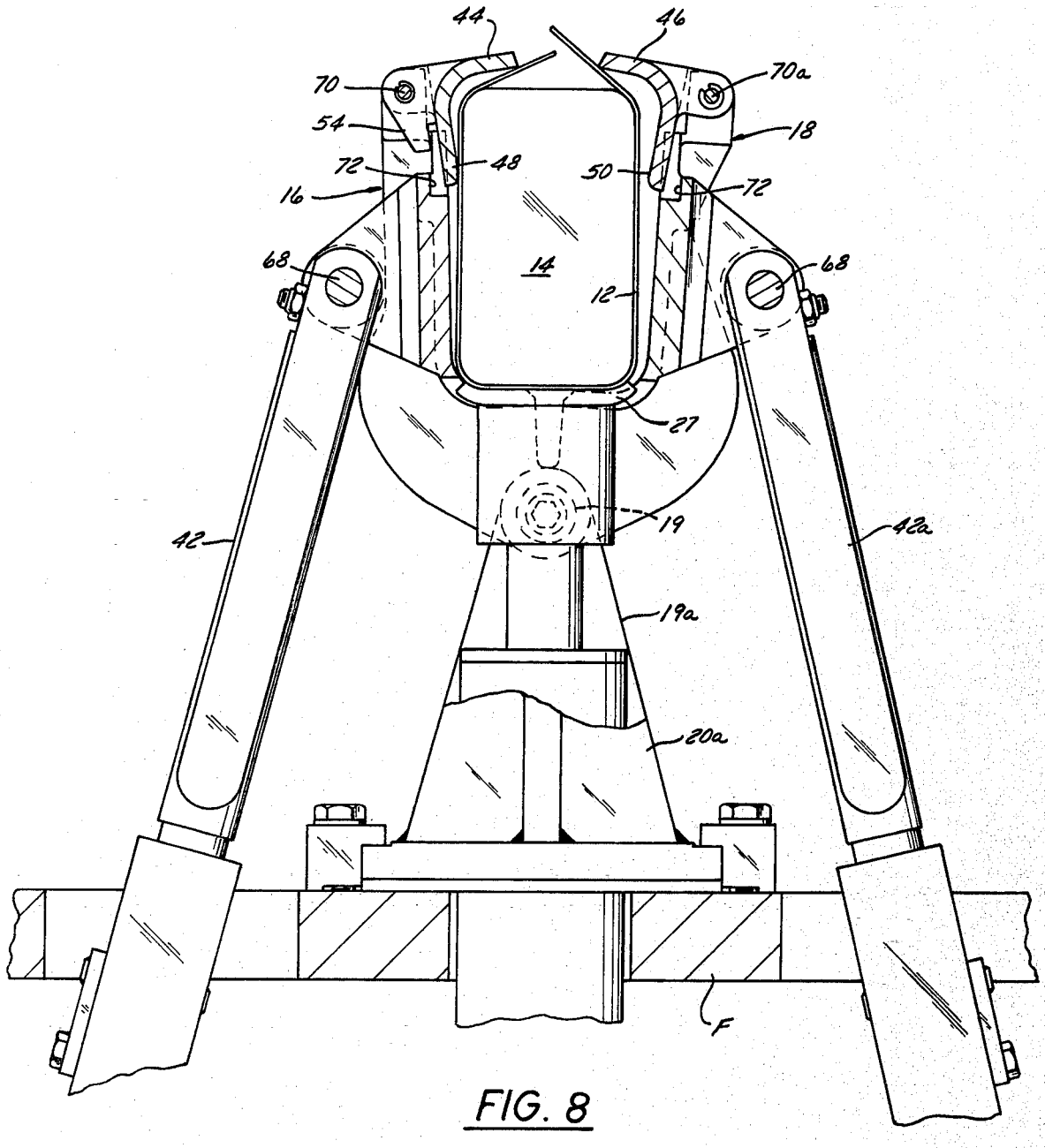
FIG. 8 is a view similar to FIG. 6, but showing the wings substantially wrapped on the mandrel, with the left wing timed slightly in advance of the right wing so as to permit overlapping of the blank edges.

With the paper container-making machine not operating or "down", the wings 16 and 18 are in the unwrapped position relative to the mandrel 14, and the pad 27 is disengaged from the mandrel 14, as shown in FIG. 6. Once the power means are activated to rotate power shaft 25, cams 24, 28 and 28*a*, which are all attached to shaft 25 to ensure a timed relationship therebetween begin rotation as well. The grippers and other paper blank positioning means referred to above place a preformed blank into position between the unwrapped wings 16 and 18 and mandrel 14. First, cam 24 actuates the shiftable blank holding means, causing power-operated cam 24 to move vertically shiftable rod 26 upwardly, which in turn causes blank holding pad 27 to move upwardly and to a position in which the pad 27 holds the blank 12 tightly to the mandrel 14 (FIG. 7). Then, with cam 24 still holding pad 27 against the blank 12 and mandrel 14, cam 28 begins raising cam follower 38 in cam track 30, which in turn raises the other end 40 of lever 32, the link 42, and wing 16 to the wrapped position around mandrel 14. Shortly after cam 28 begins this sequence, cam 28*a* begins raising cam follower 38*a* in cam track 30*a*, which in turn raises the other end 40*a* of lever 32*a*, the link 42*a*, and also wing 18 to the wrapped position around mandrel 14. As wings 16 and 16 swingingly approach mandrel 14, the legs 48 and 50 of supplement wing portions 44 and 46 abut against the mandrel 14 (FIG. 8), causing supplement wing portions 44 and 46 to pivot to a position in which they tightly press the blank against the mandrel to complete the forming of the blank therearound, and in which the adjacent parts of the supplement wing portions 44 and 46 and their respective wings 16 and 18 are linearly disposed with respect to each other. In this tightly pressing position, a space exists between the ends of the supplement wing portions, permitting a seam sealing element to be inserted therebetween, if desired. Then, the cam followers 38 and 38*a* begin their descent down their cam tracks 30 and 30*a*, lowering levers 32 and 32*a* and links 42 and 42*a* to thereby cause the wings 16 and 18 to return to the unwrapped position. As the wings 16 and 18 leave mandrel 14, their respective legs 48 and 50 return to their normal positions, i.e., wherein the legs 48 and 50 are angularly disposed with respect to the wings 16 and 18 at the points where they are adjacent. As the wings return to their unwrapped position, vertically shiftable rod 26 begins its descent on its cam 24, permitting pad 27 to release its tight engagement to the blank 12 and mandrel 14 and thereby permit the turret 22 to rotate the now shaped blank to another turret station for further processing, completing the cycle.

Recapitulation

The invention provides a high-speed machine for the manufacture of non-cylindrical paper containers, using a pair of wings to form the container on a mandrel. The invention permits rapid manufacture of such containers without striking of the ends of the ascending wings upon the sides of the mandrel, thus minimizing the noise and excessive wear upon wing ends in such machines. The mandrels and wings described above are interchangeable with cylindrical mandrels and wings therefor, permitting one with a machine formerly suited only for high-speed manufacture of cylindrical containers to substitute the wings and mandrels described above and have a machine that has been inexpensively converted to one suitable for high-speed non-cylindrical container manufacture.

What I claim is:

1. A machine for making generally rectangular in shape paper containers of the type having a successively indexable turret for presenting a workpiece to different stations, said turret having a rectangular in cross-section mandrel extending therefrom, said machine having a station for wrapping a preformed blank about said mandrel, swingable wing mechanism at said station for urging a blank against said mandrel and progressively pushing said blank tightly against and around each side of said mandrel to cause said blank to form an overlapped portion along one side of said mandrel, said mechanism comprising a pair of wings pivotably mounted together and on said machine and at a point adjacent one side of said mandrel at said station, said wings being shaped complementary to the shape of said mandrel, means for inserting a blank between said wings and said mandrel, power operated means for swinging said wings together with said blank around a portion of said mandrel in tight engagement therewith; said wings each having a supplement wing portion pivotably attached thereto for pivoting between (1) an open position away from one another to permit them to move unobstructively past said mandrel as said wings wrap said blank against said mandrel and (2) a position tightly pressing said blank against said mandrel and to form said overlapped portion of said container, said supplement wing portions being generally right angular in shape and each having an initial mandrel-contacting portion and a free end, said wing portion being pivotally attached to said wing at a point between said mandrel-contacting portion and said free end, whereby said mandrel-contacting part initially abuts against said mandrel to thereby force said supplement portions to pivot about said point to said position where they tightly press said blank against said mandrel to complete the forming of said blank therearound.

2. The machine as defined in claim 1 further characterized in that said free ends are spaced apart from one another when said portions tightly engage said mandrel whereby said overlapped portion of said container is unobstructed to thereby receive a seam-sealing element.

3. The machine as defined in claim 1 including a linkage means mounted on said machine and connected to each of said wings, a rotatably driven shaft mounted on said machine, a pair of rotatable cams secured to said shaft for rotation therewith, said linkage means each being operable by one of said cams to cause said swinging of said wings.

4. The machine set forth in claim 1 including shiftable blank holding means mounted on said machine, means for shifting said holding means in timed relationship with said wings for shifting between (1) a position in which said holding means holds a paper blank against said mandrel at a location between said wings and prior to swinging of said wings to said tightly pressing position and (2) a position away from said blank for releasing the latter after said wings have wrapped said blank around said mandrel.

5. A machine for making generally rectangular in shape paper containers of the type having a successively indexable turret for presenting a workpiece to different stations, said turret having a rectangular in cross-section mandrel extending therefrom, said machine having a station for wrapping a preformed blank about said mandrel, swingable wing mechanism at said station for urging a blank against said mandrel and progressively pushing said blank tightly against and around each side of said mandrel to cause said blank to form an overlapped portion along one side of said mandrel, said mechanism comprising a pair of wings pivotably mounted together and on said machine and of a point adjacent one side of said mandrel at said station, said wings being shaped complementary to the shape of said mandrel, means for inserting a blank between said wings and said mandrel, power operated means for swinging said wings together with said blank around a portion of said mandrel in tight engagement therewith; said wings each having a supplement wing portion pivotably attached thereto for pivoting between (1) an open position away from one another to permit them to move unobstructively past said mandrel as said wings wrap said blank against said mandrel and (2) a position tightly pressing said blank against said mandrel and to form said overlapped portion of said container, said supplement wing portions being generally right angular in shape and each having an initial mandrel-contacting portion and a free end, said wing portion being pivotally attached to said wing at a point between said mandrel-contacting portion and said free end, whereby said mandrel-contacting part initially abuts against said mandrel to thereby force said supplement portion to pivot about said point to said position where they tightly press said blank against said mandrel to complete the forming of said blank therearound; the adjacent ends of said supplement portions each having a free end which are spaced apart from one another when said portions tightly engage said mandrel whereby said overlapped portion of said container is unobstructed to thereby receive a seam-sealing element, said machine further comprising linkage means mounted thereon and connected to said wings, a powered shaft rotatably mounted on said machine, a pair of rotatable cams secured to said shaft for rotation thereby, said linkage means each being operable by one of said cams to cause successive wrapping and unwrapping of said wings around said mandrel.

6. The machine set forth in claim 5 including shiftable blank holding means mounted on said machine for operating in timed relationship with said wings and shiftable between (1) a position in which it holds a paper blank against said mandrel at a location between said wings and prior to swinging of said wings to said tightly pressing position and (2) a position away from said blank for releasing the latter after said wings have wrapped said blank around said mandrel, and means for actuating said shiftable means in timed relationship with said power operated means.

7. A machine for making generally rectangular in shape paper containers of the type having a successively indexable turret for presenting a workpiece to different stations, said turret having a rectangular in cross-section mandrel extending therefrom, said machine having a station for wrapping a preformed blank about said mandrel, swingable wing mechanism at said station for urging a blank against said mandrel and progressively pushing said blank tightly against and around each side of said mandrel to cause said blank to form an overlapped portion along one side of said mandrel, said mechanism comprising a pair of wings and further comprising a center shaft about which said wings are pivotably mounted together on said machine, said wings being shaped complementary to the shape of said mandrel, means for inserting said blank between said wings and said mandrel, power operated means for swinging each of said pair of said wings together with said blank around a portion of said mandrel in tight engagement therewith, said power operated means comprising a power-operated rotatable cam member with a cam track therein, a lever pivotably attached at one end to said machine, a cam follower attached to said lever and intermediate its length, said cam follower engageable in its cam track, a link pivotably attached at its lower end to the other end of said lever, said link pivotably attached at its upper end to said wing, whereby rotation of said rotatable cam causes actuation of said cam follower and successive wrapping and unwrapping of said wing around said mandrel; said wings each having a supplement wing portion pivotably attached thereto for pivoting between (1) an open position away from one another to permit them to move unobstructively past said mandrel as said wings wrap said blank against said mandrel and (2) a position tightly pressing said blank against said mandrel and to form said overlapped portion of said container, said supplement portions being generally right angular in shape and pivotally attached to said wing at a point intermediate the length of said portion, said portion having a leg that comprises a mandrel-contacting part which initially abuts against said mandrel to thereby force said supplement portion to pivot to said position where they tightly press said blank against said mandrel to complete the forming of said blank therearound; the adjacent ends of said supplement portions each having a free end which are spaced apart from one another when said portions tightly engage said mandrel whereby said overlapped portion of said container is unobstructed to thereby receive a seam-sealing element.

8. The machine set forth in claim 7 including shiftable blank holding means mounted on said machine for operating in timed relationship with said wings and shiftable between (1) a position in which it holds a paper blank against said mandrel at a location between said wings and prior to swinging of said wings to said tightly pressing position and (2) a position away from said blank for releasing the latter after said wings have wrapped said blank around said mandrel, and means for actuating said shiftable means in timed relationship with said power operated means.

* * * * *